US009857724B2

(12) United States Patent
Yamauchi et al.

(10) Patent No.: US 9,857,724 B2
(45) Date of Patent: Jan. 2, 2018

(54) IMAGE FORMING APPARATUS

(71) Applicant: CANON KABUSHIKI KAISHA, Tokyo (JP)

(72) Inventors: Kazumi Yamauchi, Suntou-gun (JP); Katsuichi Abe, Susono (JP); Taku Watanabe, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/245,598

(22) Filed: Aug. 24, 2016

(65) Prior Publication Data

US 2017/0060018 A1 Mar. 2, 2017

(30) Foreign Application Priority Data

Aug. 25, 2015 (JP) ..... 2015-165601

(51) Int. Cl.
*G03G 15/043* (2006.01)
*G03G 15/00* (2006.01)

(52) U.S. Cl.
CPC ..... *G03G 15/043* (2013.01); *G03G 15/5037* (2013.01)

(58) Field of Classification Search
CPC ..... G03G 15/5037
USPC ..... 399/4, 47, 48, 51
See application file for complete search history.

(56) References Cited

U.S. PATENT DOCUMENTS

| | | | | |
|---|---|---|---|---|
| 6,956,598 | B2 | 10/2005 | Fujiwara | |
| 8,983,317 | B2 | 3/2015 | Sakata | |
| 2008/0292343 | A1* | 11/2008 | Gomi | G03G 15/326 399/51 |
| 2013/0141511 | A1* | 6/2013 | Hasegawa | G03G 15/043 347/224 |
| 2013/0308969 | A1* | 11/2013 | Hasegawa | G03G 15/0266 399/50 |
| 2014/0072318 | A1* | 3/2014 | Hayakawa | G03G 15/043 399/51 |

FOREIGN PATENT DOCUMENTS

| | | | |
|---|---|---|---|
| JP | H0566638 | A | 3/1993 |
| JP | 2001265073 | A | 9/2001 |
| JP | 3388178 | B2 | 3/2003 |

(Continued)

*Primary Examiner* — Billy Lactaoen
(74) *Attorney, Agent, or Firm* — Rossi, Kimms & McDowell LLP

(57) ABSTRACT

A relationship between a light amount of an exposure portion and a surface potential according to a use amount, a first detection light amount corresponding to a prescribed surface potential in the relationship where a use amount of a photosensitive member is a first use amount and a second detection light amount corresponding to the prescribed surface potential in the relationship where the use amount of the photosensitive member is a second use amount, which is greater than the first use amount, are acquired. The exposure portion changes, as an electrostatic image forming light amount, a first image forming light amount representing a setting value under the first use amount to a second image forming light amount representing a setting value under the second use amount on the basis of a ratio of the first detection light amount to the second detection light amount.

13 Claims, 9 Drawing Sheets

(56) References Cited

FOREIGN PATENT DOCUMENTS

| | | | |
|---|---|---|---|
| JP | 2006181783 | A | 7/2006 |
| JP | 2009192705 | A | 8/2009 |
| JP | 2010122328 | A | 6/2010 |
| JP | 2012013381 | A | 1/2012 |
| JP | 2013125097 | A | 6/2013 |

* cited by examiner

IMAGE FORMING APPARATUS

BACKGROUND OF THE INVENTION

Field of the Invention

The present invention relates to an image forming apparatus employing an electrophotographic image forming system.

Description of the Related Art

An image forming apparatus such as a printer employing an electrophotographic image forming system (an electrophotographic process) uniformly charges an electrophotographic photosensitive member (hereinafter called a "photosensitive member") serving as an image bearing member and selectively exposes the charged photosensitive member to form an electrostatic latent image on the photosensitive member. The electrostatic latent image formed on the photosensitive member is visualized as a toner image by toner serving as a developer. Then, the toner image formed on the photosensitive member is transferred onto a recording member such as a recording sheet and a plastic sheet. After that, heat or pressure is applied to the toner image transferred onto the recording member to fix the toner image onto the recording member for image recording.

Such an image forming apparatus also employs, in order to facilitate various maintenance operations, a process cartridge system in which a photosensitive member and a processing section acting on the photosensitive member are integrated into a cartridge and the cartridge is attachable/detachable to/from the body of an electrophotographic image forming apparatus. Meanwhile, an electrostatic latent image described above changes its electrical characteristics according to use conditions. Particularly, the sensitivity of a photosensitive member changes due to the abrasion of the film thickness of a charge transport layer that retains exposure history or an electrostatic potential received by the photosensitive member in use. As a result, it is known that image density, particularly, an image having various density regions such as a graphic image changes.

Japanese Patent Application Laid-open No. H5-66638 discloses a method for maintaining the density of an image at a uniform level in such a way that a surface electrometer is embedded in an image forming apparatus as a section that detects potential information on a photosensitive member and fluctuations in a potential with the use of the photosensitive member are detected and corrected.

Further, Japanese Patent Application Laid-open No. 2013-125097 and Japanese Patent Application Laid-open No. 2012-13381 propose a method for easily detecting a potential of a photosensitive member in such a way that a discharge start voltage applied from a charging member and a transfer member to the photosensitive member is measured instead of a direct measurement method such as a surface electrometer as a method for detecting a potential of another photosensitive member.

In recent years, there has been a demand for reduction in cost per page (CPP) for electrophotographic image forming apparatuses and process cartridges in the market. Accordingly, both cost reduction and long service life are required to coexist in the image forming apparatuses and the process cartridges. As one of problems residing in the long service life of such an apparatus, an exposure potential changes from the initial use of a photosensitive member to the latter part of the service life with an increase in an exposure amount received by the photosensitive member. In addition, a charge transport layer greatly changes its film thickness from an initial film thickness adapted to a long service life to a thin film thickness due to abrasion after the long use of a photosensitive member, which results in fluctuations in an exposure potential. Particularly, a middle tone potential from a charge potential to an exposure potential greatly fluctuates. Therefore, there is a case that graphic images or the like may change.

Further, in order to correct a middle tone, there has been proposed a method for creating detection toner on an image bearing member such as a photosensitive member. Such a method is effective in that it allows the output of the density of a middle tone with high reproducibility from the initial use of an apparatus to the latter part of a service life. However, since a detection toner image is formed on the image bearing member to perform correction control, it takes time to perform the formation of the toner image, cleaning after the detection of the toner image, or the like. In addition, since toner is used to form the detection toner image, the toner is necessarily consumed every time the correction control is performed.

SUMMARY OF THE INVENTION

It is an object of the present invention to provide a technology by which it is possible to adjust an exposure amount in a short period of time and in a more appropriate fashion with respect to fluctuations in the exposure sensitivity characteristics of a photosensitive member.

In addition, it is another object of the present invention to provide an image forming apparatus comprising:

a photosensitive member that bears a toner image used to form an image on a recording member;

a charging portion that charges the photosensitive member;

an exposure portion that exposes the charged photosensitive member to form an electrostatic image used to form the toner image and that is capable of adjusting a light amount at which the photosensitive member is exposed;

a development portion that develops the electrostatic image as the toner image; and an acquisition portion that is used to acquire a change in exposure sensitivity characteristics of the photosensitive member in conjunction with an increase in a use amount of the photosensitive member, and that has a potential detection portion that detects a surface potential of the photosensitive member, and moreover that is capable of acquiring a relationship between the light amount of the exposure portion and the surface potential according to the use amount, wherein the acquisition portion acquires the light amount corresponding to a prescribed surface potential included in a first region that represents a region, in which the light amount and the surface potential show a linear relationship as the relationship, and includes the surface potential before exposure, and acquires a first detection light amount corresponding to the prescribed surface potential in the relationship where a use amount of the photosensitive member is a first use amount and a second detection light amount corresponding to the prescribed surface potential in the relationship where the use amount of the photosensitive member is a second use amount greater than the first use amount, and the exposure portion changes, as an image forming light amount at which the electrostatic image is formed, a first image forming light amount representing a setting value under the first use amount to a second image forming light amount representing a setting value under the second use amount on the basis of a ratio of the first detection light amount to the second detection light amount.

Further features of the present invention will become apparent from the following description of exemplary embodiments (with reference to the attached drawings).

DESCRIPTION OF THE EMBODIMENT

Hereinafter, with reference to the drawings, a mode for carrying out the present invention will be specifically described in an exemplary fashion based on embodiment. However, sizes, materials, shapes, relative arrangements, or the like of constituents described in the embodiments may be appropriately modified according to the configurations and various conditions of an apparatus to which the present invention is applied. That is, the scope of the present invention is not limited to the following embodiment.

First Embodiment

Outline of Configuration of Image Forming Apparatus

Figure 2:
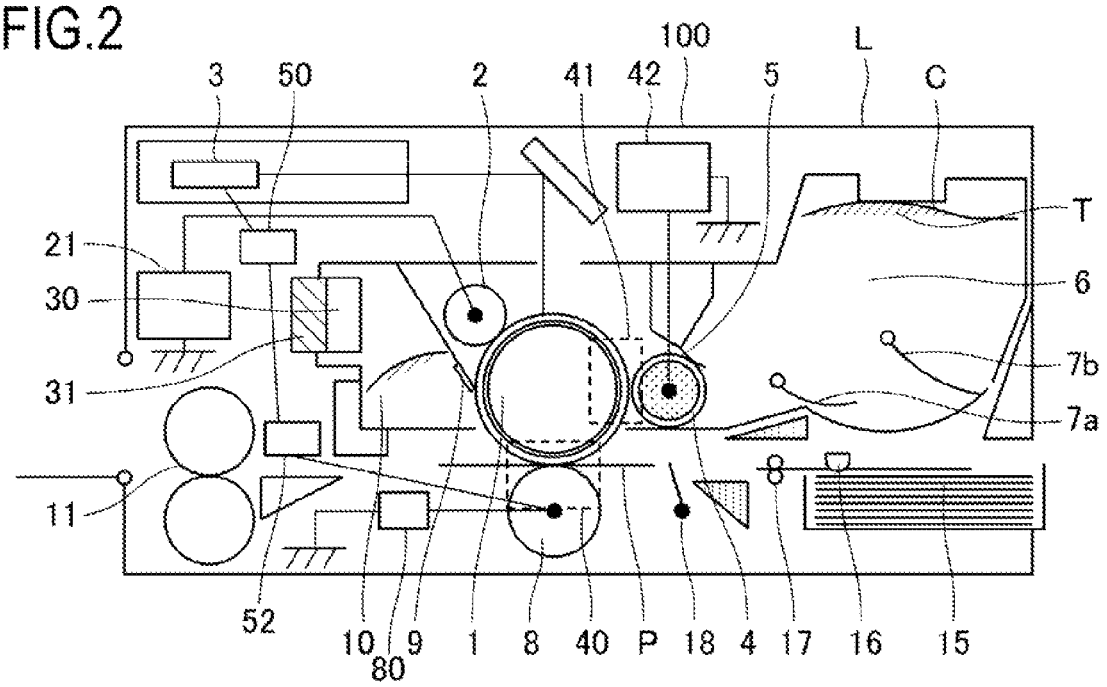
FIG. 2 is a schematic cross-sectional view of an image forming apparatus according to the first embodiment of the present invention.

FIG. 2 is a view showing the outline of the entire configuration of an electrophotographic image forming apparatus (hereinafter called an image forming apparatus) according to a first embodiment of the present invention. An image forming apparatus 100 according to the embodiment is a laser beam printer employing an electrophotographic system in which a process cartridge C is configured to be attachable/detachable to/from an apparatus body L. Here, the "apparatus body" represents a constituent that does not include the process cartridge C in the image forming apparatus 100. In addition, an image forming apparatus to which the present invention is applicable is not limited to the one shown in the embodiment. For example, the present invention is also applicable to a color laser beam printer that is provided with a plurality of process cartridges C and transfers a plurality of colors of toner images onto a recording member with an intermediate transfer belt (intermediate transfer body) to form a color image.

The image forming apparatus according to the embodiment forms an image on a sheet P (recording member) based on an electrophotographic system. That is, the sheet P is conveyed to an image forming section by a sheet feeding conveyance section to transfer a toner image onto the sheet P, and then conveyed to a fixation section to fix the toner image onto the sheet P as a permanent image. After that, the sheet P is ejected onto a sheet catching tray.

Specifically, a sheet feeding tray 15 that accommodates the sheets P in a stacked fashion is installed at the front surface part of the apparatus. The sheets P accommodated in a stacked fashion in the sheet feeding tray 15 are successively paid out from an outermost one by a sheet feeding roller 16 and fed to an image forming area 40 by a pair of conveyance rollers 17. Near the image forming area 40, a sensor lever 18 that detects the passage of the sheet P is provided. When a certain time elapses after the passage of the sheet P is detected by the sensor lever 18, a laser scanner 3 (exposure portion) applies laser light corresponding to image information onto a photosensitive member 1. As a result, an electrostatic latent image (electrostatic image) is formed on the photosensitive member 1. The electrostatic latent image is subjected to toner development in a development area 41 inside the process cartridge. A non-fixed toner image is transferred onto the sheet P by a transfer nip constituted by the photosensitive member 1 and a transfer roller 8 and fed to a fixing device 11. The sheet P having been subjected to a fixation process after passing through the fixing device 11 is conveyed and ejected to the outside of the apparatus.

The photosensitive member 1 (photosensitive drum or image bearing member) rotates clockwise in FIG. 2 and is uniformly charged when a voltage is applied to a charging roller 2 whose surface serves as a charging section. The application of the voltage is performed in such a way that electricity is supplied from a high-pressure power supply circuit 21 on the side of the apparatus body to the charging roller 2 via a charging contact (not shown). Next, by the application of laser light corresponding to image information from the laser scanner 3 onto the photosensitive member 1, an electrostatic latent image is formed on the photosensitive member 1. Then, toner is attached to the electrostatic latent image to be developed for visualization. The laser scanner 3 is configured to be capable of freely adjusting a laser light amount by a light-amount variable circuit not shown.

The charging roller 2 is provided in contact with the photosensitive member 1 and serves as a charging member that charges the photosensitive member 1. In the embodiment, the charging roller 2 rotates with the photosensitive member 1. In addition, a development section supplies toner to the development region of the photosensitive member 1 to develop an electrostatic latent image formed on the photosensitive member 1 to be visualized. The development section feeds toner T inside a toner accommodation container 6 to an area near a development roller 4 by the rotation of stirring members 7*a* and 7*b*. Then, the development section forms, while rotating the development roller 4, a toner layer where friction charges are imparted on the surface of the development roller 4 by a development blade 5. A voltage is applied from a development bias power-supply not shown to the development roller 4 to transfer toner onto the photosensitive member 1 according to a latent image. Thus, a toner image is formed on the photosensitive member 1 to be visualized. A configuration relating to the development of an electrostatic image corresponds to the development portion of the present invention.

After a toner image is transferred onto the sheet P by the transfer roller 8, toner remaining on the photosensitive member 1 is removed by a cleaning section, and then the photosensitive member 1 is subjected to a next image forming process. The cleaning section scrapes off toner remaining on the photosensitive member 1 by an elastic cleaning blade 9 provided in contact with the photosensitive member 1 and collects the scraped toner into a waste toner container 10.

In addition, in the embodiment, the process cartridge C has a memory 30 (storage portion) at the side surface part of the waste toner container 10. When the memory 30 contacts a reading/writing section 31 provided in the apparatus body L at an appropriate position, information stored in the memory 30 is transmitted to a control section 50 constituted by a CPU or the like. In a case in which the process cartridge C is installed in the apparatus body L, the memory 30 and the reading/writing section 31 are arranged opposite to each other. As the memory 30 used in the embodiment, an electronic memory constituted by normal semiconductors may be used without any limitation.

(Configuration of Photosensitive Member)

Figure 3:
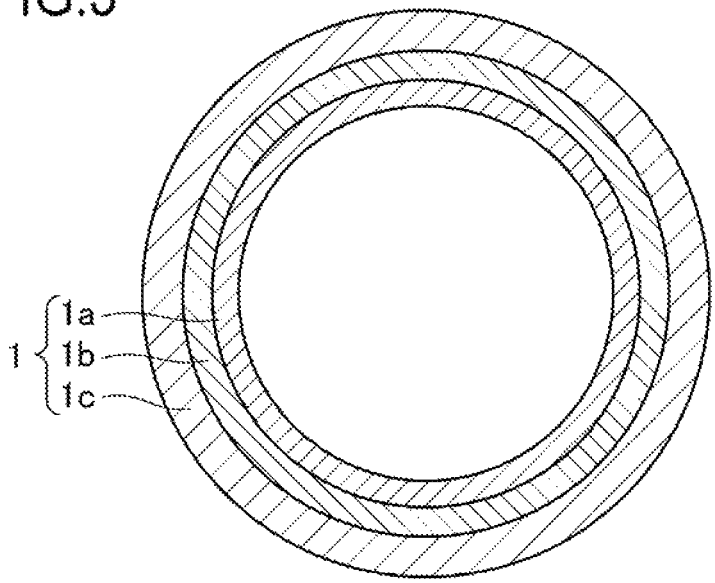
FIG. 3 is a cross-sectional view of a photosensitive member according to the first embodiment of the present invention.

FIG. 3 is a schematic cross-sectional view showing the cross-sectional configuration of the electrophotographic photosensitive member 1 according to the embodiment. In the electrophotographic photosensitive member 1, a charge generation layer 1*b* and a charge transport layer 1*c* are successively laminated on a conductive support body 1*a*. The conductive support body 1*a* is one obtained by molding metal such as aluminum, chrome, nickel, copper, and stainless steel into a drum or sheet shape, or is one obtained by laminating a metal foil on a plastic film. The charge generation layer 1*b* is formed in such a way that a charge generation material such as a phthalocyanine compound and an azo pigment is dispersed into a binding resin such as polyvinyl butyral, polyvinyl acetate, and acryl and then a resulting dispersed solution is coated or the above pigment is vacuum-deposited. The charge generation layer 1*b* preferably has a film thickness of 5 μm or less and particularly preferably has a film thickness of 0.05 to 3 μm. The charge transport layer 1*c* is formed using a coating solution in which a charge transport material such as a polycyclic aromatic compound having the structure of biphenylene, anthracene, pyrene, phenanthrene, or the like, indole, carbazole, a pyrazoline compound, and a styrene compound in a main chain or a side chain is dissolved into a resin having film-forming properties. Examples of such a resin include polycarbonate and a polyester resin having higher abrasion resistance properties.

(Fluctuations in Density)

As one of major factors causing fluctuations in the density of an electrophotographic image forming apparatus, a change in the sensitivity of a photosensitive member has been known. In the photosensitive member, a carrier remains due to the history of received laser exposure, or sensitivity changes due to the abrasion of a charge transport layer. When the sensitivity of the photosensitive member changes due to abrasion or the like, the use mode of the photosensitive member is digitized and various conditions such as a charging bias, a development bias, and an exposure amount are changed according to a measurement result. Then, the development bias relative to an exposure potential during image formation is controlled to be fixed to obtain stable density. Further, as shown in Japanese Patent Application Laid-open No. H5-66638, potential information on a photosensitive member is measured by a surface electrometer to perform density correction or the like based on a correct exposure potential.

The above methods exhibit substantial performance as for solid density. However, density stability for a variety of output images regardless of use conditions has also been demanded in the market. Specifically, as inexpensive small machines, apparatuses capable of everlastingly maintaining graphic images or the like with good reproducibility through an endurance test have been demanded. As a response to such a demand, the detection of an exposure amount during image formation has been insufficient. According to the embodiment, an exposure potential of the photosensitive member is measured by a discharge threshold measurement technology, and sensitivity characteristics are obtained by measuring not only an exposure potential with respect to a solid density part but also a middle tone such as a halftone to correct fluctuations in density in a middle tone region that changes according to use conditions. In the way described above, the embodiment has an object of obtaining a stable halftone image.

Figure 4:
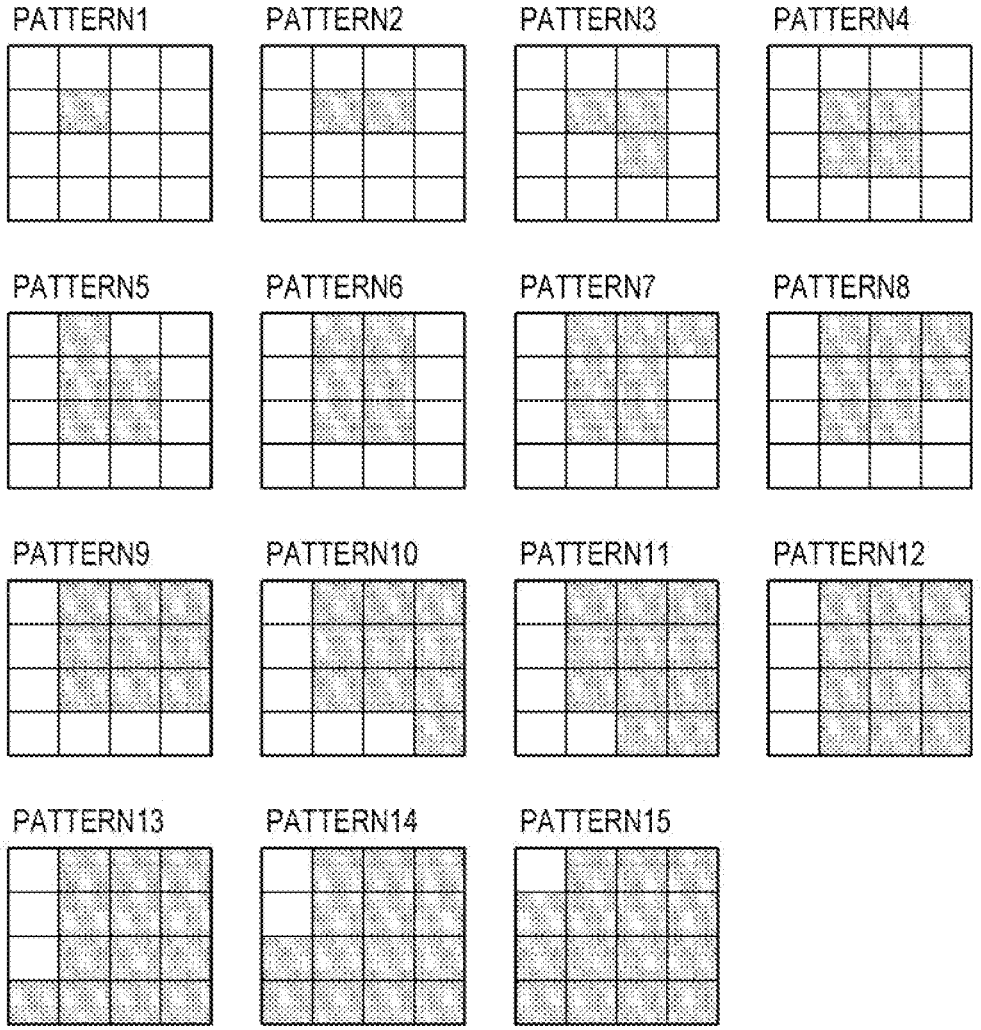
FIG. 4 is a diagram showing halftone patterns according to the first embodiment of the present invention.

A description will be given of a halftone with reference to FIG. 4. A halftone image used in the embodiment is provided with dot patterns of a pattern 1 to a pattern 15. Locally, the surface of the photosensitive member is constituted by a bright part potential and a dark part potential. The halftone is a high density halftone when the ratio of the bright part potential is high, and is a low density halftone when the ratio is low. Thus, the density of the halftone is made different depending on the use conditions of the photosensitive member since the potential distribution of the constituent dots fluctuates.

Figure 5:
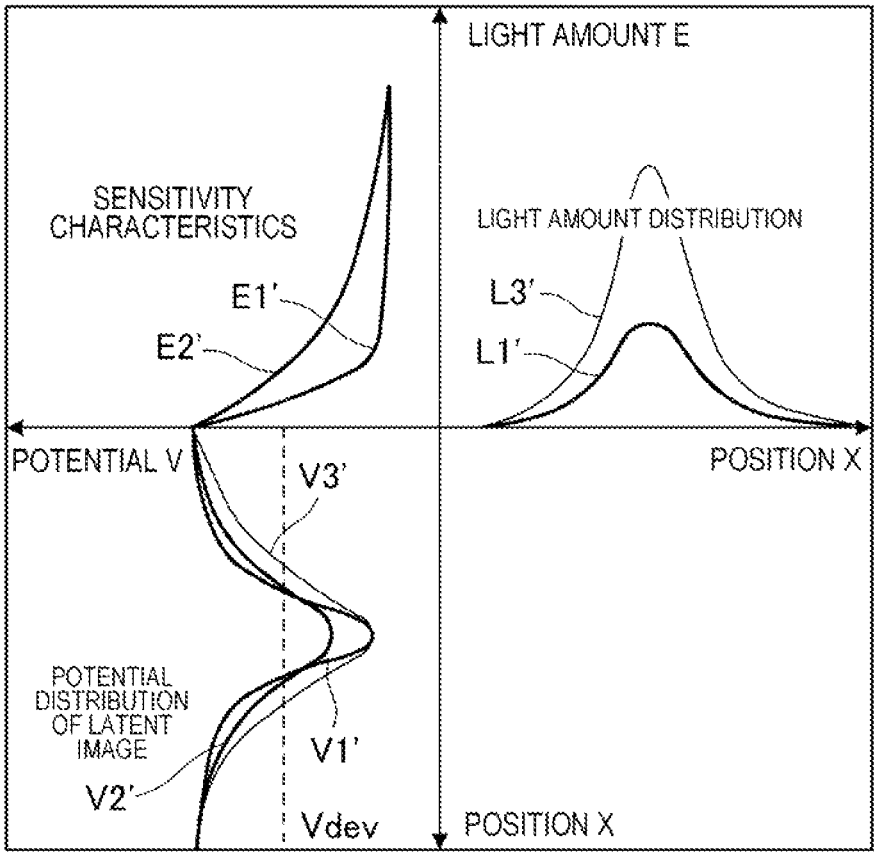
FIG. 5 is an explanatory diagram of the sensitivity characteristics of the photosensitive member, the light-amount distribution of the spots of laser light, and an exposure potential distribution.

A description will be given of the fluctuations in the potential distribution of the dots with reference to FIG. 5. FIG. 5 is a graph showing the relationships between the light-amount distribution of the spots of an exposure beam, the sensitivity characteristics of the photosensitive member, and an electrostatic latent image formed on the photosensitive member. A first quadrant represents the light-amount distribution of the exposure beam. In the first quadrant, the horizontal axis shows a position x, and the vertical axis shows a light amount E. A second quadrant represents the sensitivity characteristics of the electrophotographic photosensitive member. In the second quadrant, the vertical axis shows the light amount E, and the horizontal axis shows a potential V of the photosensitive member. A third quadrant represents the potential distribution of an electrostatic latent image projected when the light-amount distribution of the exposure beam and the sensitivity characteristics of the photosensitive member are taken into consideration. In the third quadrant, the horizontal axis shows the potential V, and the vertical axis shows the position x.

In FIG. 5, E1' represents the sensitivity characteristics of a photosensitive member A in which the charge transport layer has an initial thickness of 20 μm, and E2' represents the sensitivity characteristics of a photosensitive member B in which the charge transport layer has been worn to 10 μm as a result of the endurance test of the photosensitive member. Further, V3' represents the potential distribution of the electrostatic latent image when an exposure amount L3' is set to make the exposure potential of the photosensitive member B coincident with that of the photosensitive member A to have substantially the same solid density. When the laser exposure amount is adjusted to make the exposure potentials coincident with each other, potentials near the apexes of dots corresponding to the solid density become equal to each other. However, there is a case that intermediate regions generated on the photosensitive bodies in halftone formation may be different from each other. In this case, it is necessary to set the exposure light amount to make the intermediate regions coincident with each other during image formation.

(Exposure Potential Measurement Method)

Figure 6:
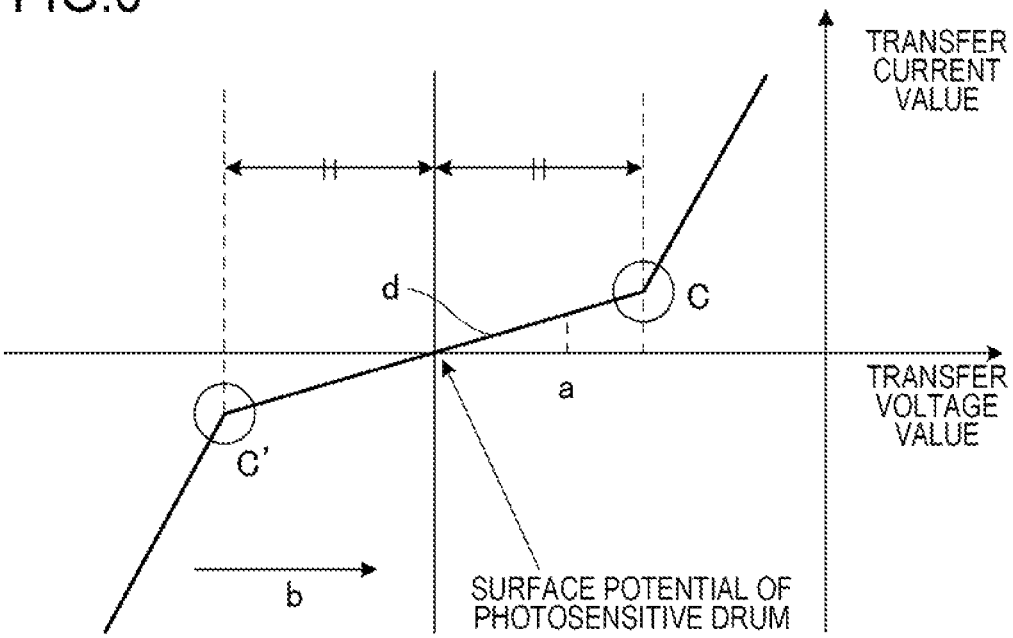
FIG. 6 is an explanatory diagram of a method for detecting the surface of a photosensitive member according to the first embodiment of the present invention.

A description will be given of an exposure potential measurement section used in the embodiment with reference to FIG. 6. In the embodiment, an exposure potential of the surface of the photosensitive member is measured (detected) using a transfer roller. Further, since a circuit configuration for the measurement is the same as those of Japanese Patent Application Laid-open No. 2013-125097 and Japanese Patent Application Laid-open No. 2012-13381, its detailed description will be omitted.

With the application of laser light, an exposure potential (Vl) is formed with respect to a charge potential (Vd) formed on the photosensitive member by the charging roller (surface potential before exposure). A transfer bias (Tv) is applied when a portion formed at the exposure potential (Vl) reaches the transfer roller, and a current value (I) flowing through the transfer roller at this time is monitored. It is assumed that the transfer bias applied to the transfer roller here is a DC voltage. The transfer bias is caused to successively increase (as indicated by arrow b in FIG. 6) with an expected exposure potential as a start point (for example, a). In this process, there is a point (for example, c) of the transfer bias (Tv') at which the ratio of the increase in the current value (I) changes. That is, the voltage at this point represents a discharge start voltage at which a discharge current starts flowing besides a resistance current value component flowing between the transfer roller and the photosensitive member. The above operation is performed on both polarities of a positive polarity side (+Tv') and a negative polarity side (−Tv') based on the expected exposure potential. An intermediate value (d) of the bipolar discharge start voltages (c, c') obtained by the above detection is the potential on the photosensitive member and just equivalent to the exposure potential (Vl).

(Method for Correcting Image Forming Exposure Amount)

Figure 7:
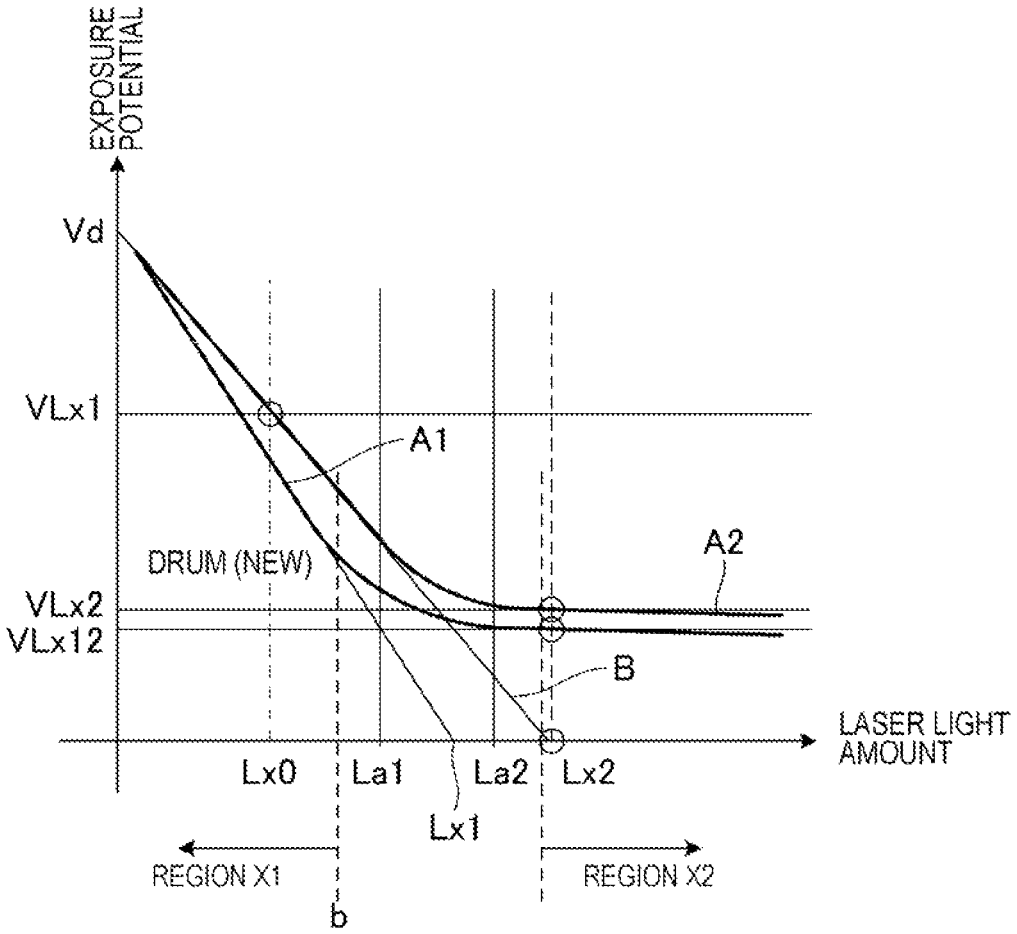
FIG. 7 is an explanatory diagram of a method for correcting an exposure amount during image formation according to the first embodiment of the present invention.

With reference to FIG. 7, a description will be given of a method for correcting a halftone potential according to the embodiment. FIG. 7 is a diagram showing the relationship between the light amount and the exposure potential in a coordinate system with the laser light amount on one axis and the exposure potential (the surface potential of the photosensitive member after charging exposure) on the other axis. In the embodiment, photosensitive member sensitivity information (the relationship between a light amount under the first use amount of the photosensitive member and a surface potential after charging exposure) stored in the cartridge memory of an initial cartridge (in an unused state, i.e., a new cartridge), the photosensitive member sensitivity information representing the relationship between a plurality of light amounts and exposure potentials obtained by the exposure potential measurement unit. The method for correcting a halftone potential is characterized in that, during the use of the cartridge, a detection exposure amount is set based on initial sensitivity information and the sensitivity of the photosensitive member in use is detected based on a measured exposure potential to determine a solid exposure amount at which the correction of the halftone potential is allowed.

As shown in FIG. 7, in many cases, the characteristics of the exposure amount and the exposure potential of the photosensitive member 1 may be classified into a low light-amount region X1 (first region, i.e., first linear region) where the light amount is relatively smaller than an image forming light amount and a high light-amount region X2 (second region, i.e., second linear region) where the light amount is relatively larger than the image forming light amount.

In the light-amount region X1, the exposure potential with respect to a generated carrier (ΔQ) decreases approximately linearly (ΔV). As the exposure amount further increases from the light-amount region X1, a decrease in the exposure potential with respect to the light amount reduces. It is assumed that the exposure potential reduces as the exposure amount increases and thus the generated carrier tends to hardly move to the surface.

In FIG. 7, A1 shows the sensitivity characteristics of the photosensitive member in which the charge transport layer has a thickness of 21 μm (as a new one), and A2 shows the sensitivity characteristics of the photosensitive member in which the thickness of the charge transport layer has been worn to 8 μm after the use of the apparatus.

(Method for Calculating Sensitivity Characteristics when Apparatus is in Use)

Within the linear region (light-amount region X1) in which the light amount and the exposure potential show a linear relationship in the sensitivity characteristics A1 where the photosensitive member is in the initial stage, a detection light amount Lx0 is selected. The sensitivity characteristics of the photosensitive member changes from A1 to A2 with the use of the photosensitive member. As shown in FIG. 7, the linear regions (light-amount regions X1 and X2) of the sensitivity characteristics change so as to spread as light-amount regions with the use of the photosensitive member (spread in the right direction of FIG. 7). Accordingly, even after the sensitivity characteristics change from A1 to A2 with the use of the photosensitive member, the detection light amount Lx0 falling within the linear region of the sensitivity characteristics A1 where the photosensitive member is in the initial stage falls within the linear region of the sensitivity characteristics A2 where the photosensitive member is in use. Thus, when an exposure potential VLx1 at the detection light amount Lx0 is detected according to the above exposure potential measurement method, a linear expression β (second relational expression) according to which a dark part potential (0, Vd) and the exposure potential (Lx0, VLx1) are connected to each other may be obtained. The linear expression β may be regarded as one showing the characteristics of the linear region where the photosensitive member is in use (characteristics under a second use amount of the photosensitive member). A linear expression α (first relational expression) showing the characteristics of the linear region where the photosensitive member is in the initial stage (characteristics under the first use amount of the photosensitive member) is stored in advance in the memory 30. The linear region (light amount region X1) including the dark part potential is a region including mainly a region showing the density characteristics of a middle tone in a toner image in the exposure sensitivity characteristics of the photosensitive member 1.

The control section 50 is capable of acquiring the light amounts corresponding to the exposure potentials of the same sizes, i.e., a light amount (first detection light amount) in the linear expression α and a light amount (second detection light amount) in the linear expression β as a characteristics acquisition portion (acquisition portion) that acquires a change in the exposure sensitivity characteristics of the photosensitive member with an increase in the use amount of the photosensitive member. In the embodiment, a light amount Lx1 at the x intercept (intersection with the x axis) of the linear expression α is used as the first detection light amount, and a light amount Lx2 at the x intercept (intersection with the x axis) of the linear expression β is used as the second detection light amount. The exposure portion changes the image forming light amount from La1 (first image forming light amount), which represents an initial setting value or a setting value before being changed, to La2 (second image forming light amount) based on the ratio of the light amount Lx1 to the light amount Lx2 (Lx2/Lx1) in the light-amount region X1. Further, the control section 50 forms, as another acquisition portion that acquires a voltage-current relational expression (FIG. 6) used to detect a surface potential of the photosensitive member, a potential detection portion that detects an exposure potential together with the transfer roller 8 and a detection circuit 52 (current detection portion) (FIG. 2) that detects a current flowing through the transfer roller 8. As described above, the voltage-current relational expression is a relational expression between a voltage value of a transfer bias applied to the photosensitive member 1 by the transfer roller 8 when electricity is supplied from a high-pressure power supply circuit 80 and a detection current value detected by the detection circuit 52 when the transfer bias is applied. The relational expression includes a discharge start voltage value at which a discharge starts between the transfer roller 8 and the photosensitive member 1. According to the rotational expression, the intermediate value of the bipolar discharge start voltage value may be detected as a surface potential of the photosensitive member.

Further, as shown in FIG. 7, the exposure amount Lx2 at the intersection point between the linear expression β and the x axis falls within the region (light amount region X2) in which the inclination of the exposure potential with respect to the exposure amount is small. The region represents a light amount at which the exposure potential becomes 0 V due to the linear characteristics of the sensitivity of the photosensitive member (potential change amount becomes substantially zero with the saturation of a change in the exposure potential), and represents a light amount region in which an amount of a carrier remaining in the photosensitive member increases. An exposure potential VLx2 at the light amount Lx2 is detected according to the above exposure potential measurement method to obtain (Lx2, VLx2). An exposure potential VLx12 at the light amount Lx2 under the sensitivity characteristics A1 where the photosensitive member is in the initial stage is read from the memory, and VLx2 is compared with VLx12 to change the image forming light amount from La1 (or La0) to La2 (La2=Lx2/Lx1×La1). As for a development bias, a current development bias Vdev (or VdevA0) (first development bias) is changed to VdevA (or VdevA1) (=Vdev−VLx2+VLx12) (second development bias) in order to optimize solid density. That is, the control section 50 acquires the exposure potential VLx12 (first detection potential) under the sensitivity characteristics A1 where the photosensitive member is in the initial stage and the exposure potential VLx2 (the second detection potential) under the sensitivity characteristics A2 where the photosensitive member is in use, the exposure potentials VLx12 and VLx2 being exposure potentials corresponding to the light amount Lx2 of the same size. The control section 50 is configured to be capable of controlling power to be supplied to the development roller 4 with the control of a development bias power supply circuit 42 (FIG. 2), and configured to be capable of adjusting a size of the development bias to be applied to the photosensitive member 1 by the development roller 4. The control section 50 changes the size of the development bias to be applied by the development roller 4 from the development bias Vdev representing the current (initial) setting value to VdevA when a difference in the absolute values between VLx12 and VLx2 is greater than or equal to a threshold (≥ΔV). The absolute value of the size of the development bias to be changed is the same as the difference in the absolute values between VLx12 and VLx2.

(Reason why Image Forming Light Amount is Changed)

Figure 8:
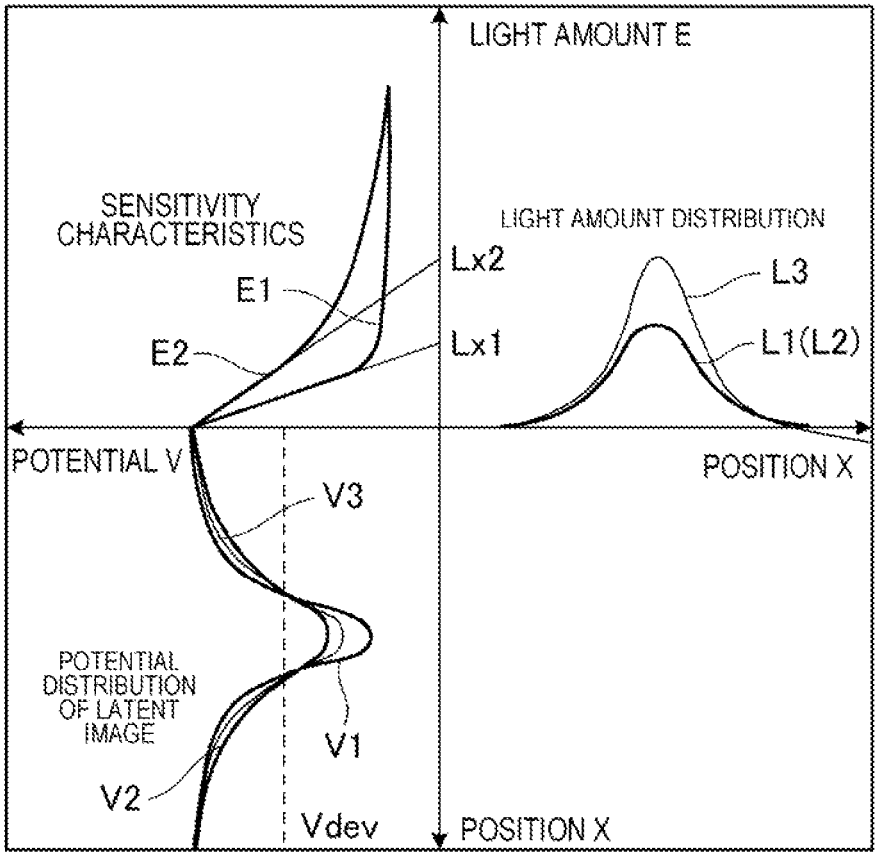
FIG. 8 is an explanatory diagram of the sensitivity characteristics of the photosensitive member, the light-amount distribution of the spots of laser light, and an exposure potential distribution.

FIG. 8 is a graph showing the relationships between the light-amount distribution of the spots of the exposure beam, the sensitivity characteristics of the photosensitive member, and an electrostatic latent image formed on the photosensitive member, which are realized by light-amount control according to the embodiment. E1 represents the sensitivity characteristics of the photosensitive member (sensitivity characteristics under the first use amount of the photosensitive member) in which the charge transport layer 20 has an initial thickness of 20 μm (charge transport layer is in an unused state, i.e., the charge transport layer is new), and E2 represents the sensitivity characteristics of the photosensitive member (sensitivity characteristics under the second use amount of the photosensitive member) in which the charge transport layer has been worn to 10 μm when the photosensitive member is subjected to an endurance test. The profile of E1 spread in an X-axis direction with respect to the profile of E2. The magnification is close to the ratio of the linear region of E1 to that of E2, and may be roughly calculated as about Lx2/Lx1. The electrostatic latent image corresponds to the light-amount distribution of the exposure beam, and the profile of the electrostatic latent image where the charge transport layer has a thickness of 10 μm may be made close to the profile of an initial electrostatic latent image in such a way that the image forming light amount is changed using the ratio Lx2/Lx1 (V3 in FIG. 8 with respect to V3' in FIG. 5). Since solid density is determined based on the exposure potential, development contrast may be made close to initial contrast in such a way that the development bias is changed using VLx2 and VLx12 as described above.

(Flowchart of Method for Correcting Image Forming Exposure Amount)

Figure 1A:
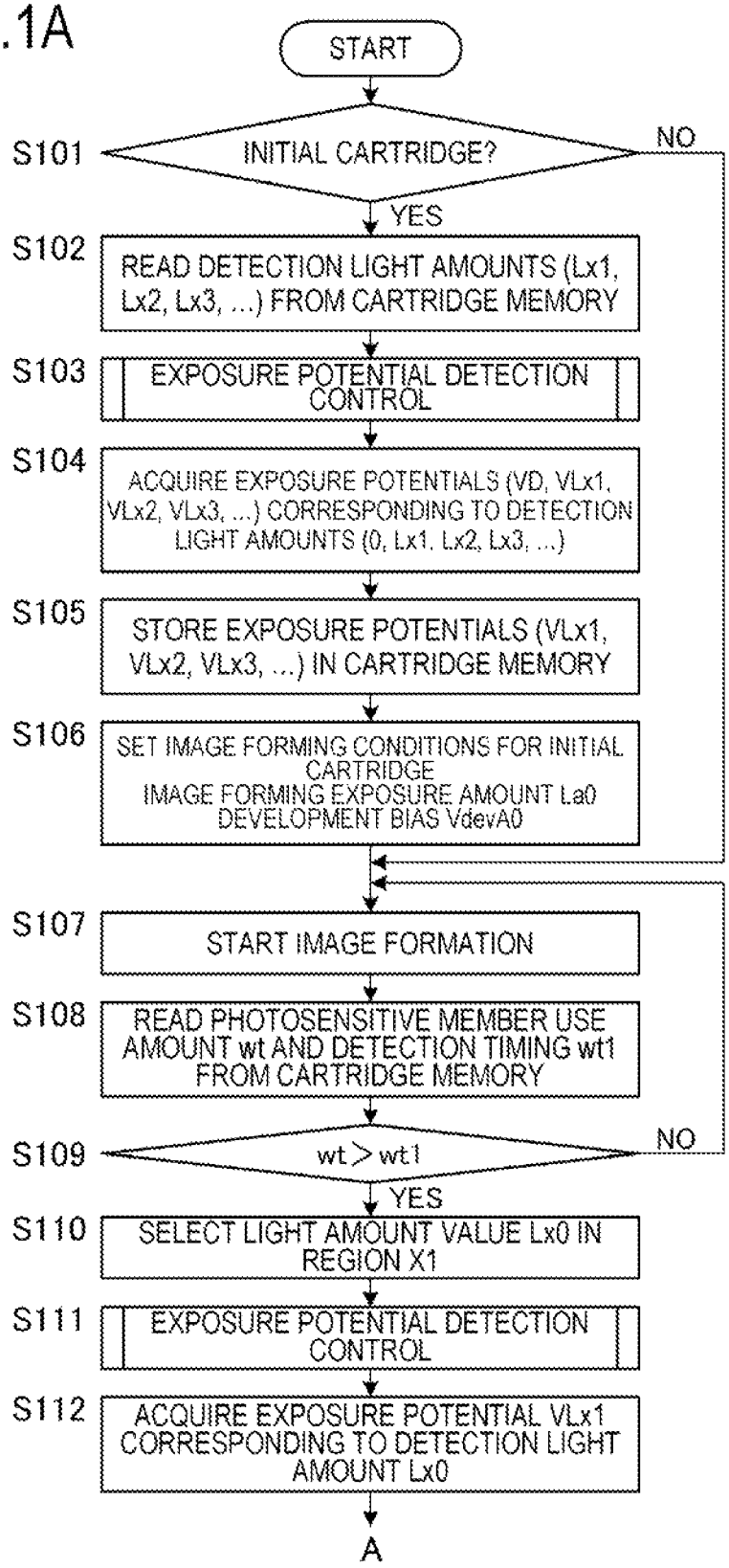
FIG. 1A is a control flowchart according to a first embodiment of the present invention.
Figure 1B:
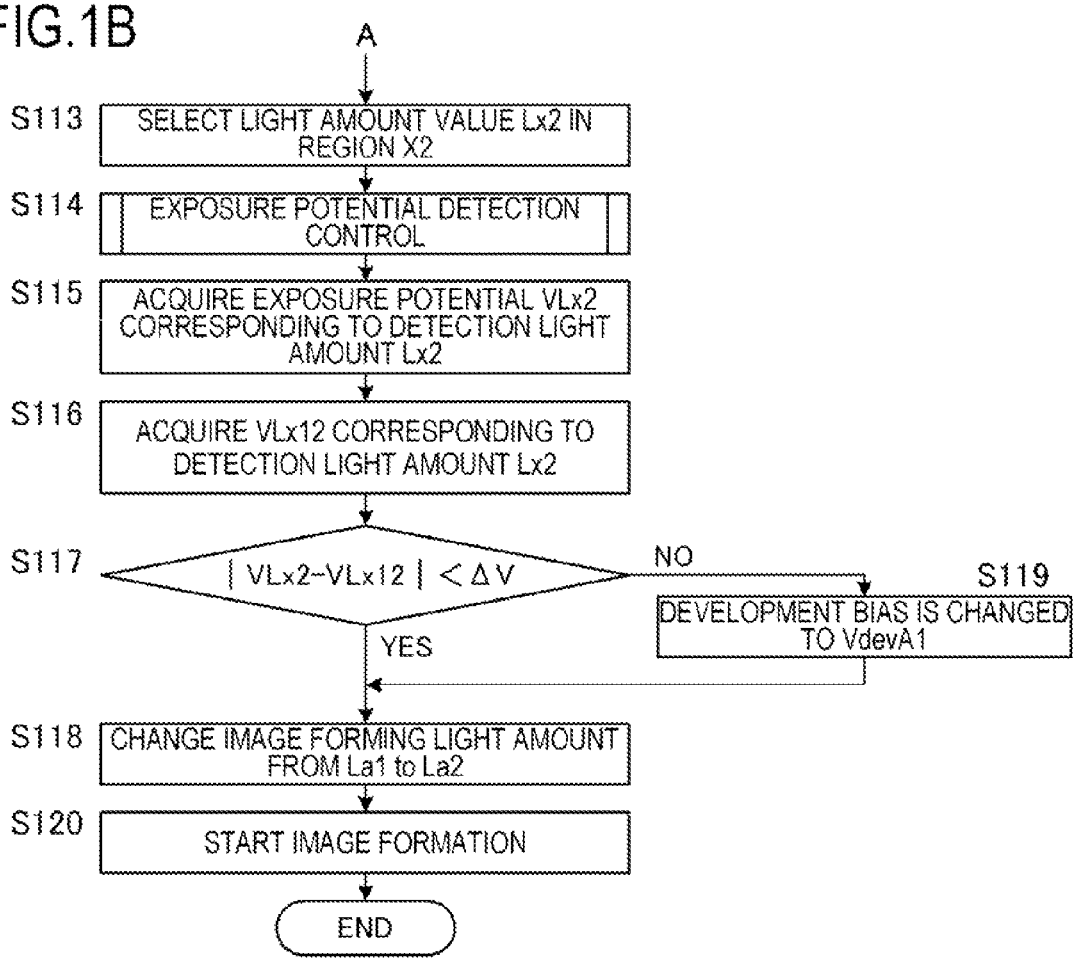
FIG. 1B is the control flowchart according to the first embodiment of the present invention.

A description will be given of the operation of the image forming apparatus as an actually-applied example using the flowchart of FIGS. 1A and 1B. Note that since a potential of the photosensitive member is obtained according to the above exposure potential measurement method, a detailed description of the flowchart of an exposure potential detection sequence will be omitted. Note that the operation of correcting the sensitivity of the photosensitive member that fluctuates according to a use amount of a new cartridge since the start of using the new cartridge will be described.

S101: A determination is made as to whether the cartridge is in an initial stage. When the cartridge is in the initial stage ("Yes"), the exposure potential detection sequence starts. On the other hand, when the cartridge is not in the initial stage ("No"), an image forming operation starts.

S102: The detection light amounts (Lx1, Lx2, Lx3, . . . ) stored in the cartridge memory are read.

S103: An exposure potential detection control sequence starts.

S104: The exposure potentials (VLx1, VLx2, VLx3, . . . ) corresponding to the detection light amounts and a potential VD at a non-exposure time are detected.

S105: The exposure potentials (VLx1, VLx2, VLx3, . . . ) are stored in the cartridge memory.

S106: Image forming conditions (image forming exposure amount La0 and development bias VdevA0) for the initial cartridge are set.

S107: The image forming operation starts.

S108: A photosensitive member use amount wt and a photosensitive member use amount threshold wt1 at which photosensitive member exposure potential detection starts are read from the cartridge memory. The use amount may be indicated by various indexes showing the frequency of the use of the photosensitive member such as the number of the formation times of images and the number of the rotations of the photosensitive member and is not particularly limited.

S109: The photosensitive member use amount wt is compared with the use amount threshold wt1. When the photosensitive member use amount wt is smaller than the use amount threshold wt1, the processing returns to S107. On the other hand, when the photosensitive member use amount wt is greater than the use amount threshold wt1, the processing proceeds to S110.

S110: The light amount value Lx0 in the region in which the exposure potential and the light amount show a linear relationship is selected.

S111: The exposure potential detection control sequence starts.

S112: The exposure potential VLx1 corresponding to the detection light amount Lx0 is acquired.

S113: The light amount value Lx2 corresponding to a remaining potential region (region X2) is selected.

S114: The exposure potential detection control sequence starts.

S115: The exposure potential (VLx2) corresponding to the detection light amount Lx2 is acquired.

S116: The exposure potential (VLx12) corresponding to the detection light amount Lx2 under the sensitivity characteristics A1 where the photosensitive member is in the initial stage is acquired.

S117: When $|VLx2-VLx12|<\Delta V$ is established ("Yes"), the image forming light amount is changed from La1 to La2 (S118). On the other hand, when $|VLx2-VLx12|<\Delta V$ is not established ("No"), the development bias is also changed from VdevA0 to VdevA1 (S119) besides the change in the image forming light amount.

S120: Image formation is performed based on the above settings after the changes.

(Verification of Effects)

Next, in order to confirm the effects of the embodiment, a comparative experiment was conducted between the following Example and Comparative Examples.

EXAMPLE

Photosensitive drum (initial): The charge transport layer had a film thickness of 21 μm.

Photosensitive drum (after endurance test): The charge transport layer had a film thickness of 8 μm.

Light amount (initial) during image formation: 3.0 mJ/m^2

Rotation speed of photosensitive member: 100 (rpm)

Charge potential: −500 (V)

Development bias: −400 (V)

Image correction control: The light amount correction and the development voltage correction control described in the first embodiment.

Comparative Example 1

Comparative Example 1 had the same configurations as those of Example other than image correction control.

No image correction control was performed.

Comparative Example 2

Comparative Example 2 had the same configurations as those of Example other than the image correction control.

During image formation, an exposure amount was measured and made constant regardless of a use amount of the photosensitive member.

(Experiment)

Further, the following experiment was conducted about the configuration of Example of the present invention.

(Measurement of Halftone Density)

In order to compare the reproducibility of a halftone, halftone density in a halftone having a dot ratio of 50% was measured until the charge transport layer had a film thickness of 10 μm showing the end of the use of the photosensitive drum since the initial use of the photosensitive drum (under Macbeth RD917). As evaluation conditions, the image forming apparatus was left to stand at a temperature of 25° C. and a relative humidity of 50% for one day and caused to output 50,000 A4-size prints intermittently. When the sheets are intermittently fed, next printing is performed after a standby state following previous printing.

(Results)

The change in the density of the initial photosensitive drum and the photosensitive drum after the endurance test

| | Solid Density | 50% HT |
|---|---|---|
| Example 1 | −5% | −5% |
| Comparative Example 1 | −20% | −40% |
| Comparative Example 2 | −5% | +20% |

In Comparative Example 1, solid density and the halftone density were decreased due to the abrasion of the photosensitive member. In Comparative Example 2, the halftone density was increased as a result of increasing the exposure amount to make the surface potentials coincident with each other. This is because the light amount correction was performed without adjusting a halftone potential. Conversely, in Example, good results were obtained in both the solid density and the halftone density.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-165601, filed Aug. 25, 2015, which is hereby incorporated by reference herein in its entirety.

What is claimed is:

1. An image forming apparatus comprising:

a photosensitive member that bears a toner image used to form an image on a recording member;

a charging portion that charges the photosensitive member;

an exposure portion that exposes the charged photosensitive member to form an electrostatic image used to form the toner image and that is capable of adjusting a light amount at which the photosensitive member is exposed;

a development portion that develops the electrostatic image as the toner image; and an acquisition portion that is used to acquire a change in exposure sensitivity characteristics of the photosensitive member in conjunction with an increase in a use amount of the photosensitive member, and that has a potential detection portion that detects a surface potential of the photosensitive member, and moreover that is capable of acquiring a relationship between the light amount of the exposure portion and the surface potential according to the use amount, wherein the acquisition portion acquires the light amount corresponding to a prescribed surface potential included in a first region that represents a region, in which the light amount and the surface potential show a linear relationship as the relationship, and includes the surface potential before exposure, and acquires a first detection light amount corresponding to the prescribed surface potential in the relationship where a use amount of the photosensitive member is a first use amount and a second detection light amount corresponding to the prescribed surface potential in the relationship where the use amount of the photosensitive member is a second use amount greater than the first use amount, and the exposure portion changes, as an image forming light amount at which the electrostatic image is formed, a first image forming light amount representing a setting value under the first use amount to a second image forming light amount representing a setting value under the second use amount on the basis of a ratio of the first detection light amount to the second detection light amount.

2. The image forming apparatus according to claim 1, wherein a ratio of the second image forming light amount to the first image forming light amount is the same as a ratio of the second detection light amount to the first detection light amount.

3. The image forming apparatus according to claim 1, wherein the acquisition portion acquires, in a coordinate with the light amount on one axis and the surface potential on the other axis, a first relational expression showing a relationship between the light amount and the surface potential in the first region under the first use amount and a second relational expression showing a relationship between the light amount and the surface potential in the first region under the second use amount, and $La2=Lx2/Lx1\times La1$ is satisfied, where $Lx1$ represents a light amount at an intersection with the one axis in the first relational expression as the first detection light amount, $Lx2$ represents a light amount at an intersection with the one axis in the second relational expression as the second detection light amount, $La1$ represents the first image forming light amount, and $La2$ represents the second image forming light amount.

4. The image forming apparatus according to claim 1, wherein the development portion is capable of adjusting a size of a development bias to be applied to the photosensitive member to develop the electrostatic image as the toner image, the acquisition portion acquires, as the surface potentials corresponding to a light amount of the same size, a first detection potential under the first use amount and a second detection potential under the second use amount, which is greater than the first use amount, in a second region in which a change in the surface potential with respect to an increase in the light amount becomes substantially zero in the relationship, and the development portion changes, when the exposure portion changes the first image forming light amount to the second image forming light amount, a first development bias representing the development bias and used as a setting value under the first use amount to a second development bias on the basis of a difference in absolute values between the first detection potential and the second detection potential when the difference in the absolute values between the first detection potential and the second detection potential is greater than or equal to a prescribed threshold.

5. The image forming apparatus according to claim 4, wherein a difference in absolute values between the first development bias and the second development bias is the same as the difference in the absolute values between the first detection potential and the second detection potential.

6. The image forming apparatus according to claim 4, wherein $VdevA=Vdev-VLx2+VLx12$ is satisfied, where $VLx12$ represents the first detection potential, $VLx2$ represents the second detection potential, $Vdev$ represents the first development bias, and $VdevA$ represents the second development bias.

7. The image forming apparatus according to claim 1, wherein the relationship under the first use amount represents the relationship where the photosensitive member is in an unnused state.

8. The image forming apparatus according to claim 1, wherein a cartridge including at least the photosensitive member is configured to be attachable/detachable to/from a body of the image forming apparatus, the cartridge has a storage portion that stores the relationship, and the relationship under the first use amount is stored in advance in the storage portion.

9. The image forming apparatus according to claim 1, wherein, when the use amount is greater than a prescribed threshold with respect to the first use amount, the acquisition portion acquires the second detection light amount, and the exposure portion changes the first image forming light amount to the second image forming light amount.

10. The image forming apparatus according to claim 1, wherein the first region includes a region showing density characteristics of a middle tone in the toner image as the exposure sensitivity characteristics.

11. The image forming apparatus according to claim 1, wherein the potential detection portion includes:

a transfer member that applies a transfer bias, by which the toner image borne on the photosensitive member is transferred onto the recording member, to the photosensitive member;

a current detection portion that detects a current flowing through the transfer member; and another acquisition portion that acquires a voltage-current relational expression showing a relationship between a voltage value of the transfer bias and a detection current value detected by the current detection portion with the application of the transfer bias.

12. The image forming apparatus according to claim 11, wherein the voltage-current relational expression includes a discharge start voltage value at which a discharge starts between the transfer member and the photosensitive member at the voltage value.

13. The image forming apparatus according to claim 12, wherein the potential detection portion detects, as the surface potential, an intermediate value of the bipolar discharge start voltage value in the voltage-current relational expression.

* * * * *